US006646638B1

(12) United States Patent
Yeung et al.

(10) Patent No.: US 6,646,638 B1
(45) Date of Patent: Nov. 11, 2003

(54) DRIVING SCHEME FOR LIQUID CRYSTAL DISPLAY

(75) Inventors: Steven Wai Leung Yeung, Tseung Kwan O (HK); Siu Kwan Kwok, Tseung Kwan O (HK); James G. N. Lee, Tseung Kwan O (HK); Celene Chang, Tseung Kwan O (HK)

(73) Assignee: Varintelligent (BVI) Limited, Tortola (VG)

( * ) Notice: Subject to any disclaimer, the term of this patent is extended or adjusted under 35 U.S.C. 154(b) by 0 days.

(21) Appl. No.: 09/564,488

(22) Filed: May 4, 2000

(30) Foreign Application Priority Data

May 4, 1999 (GB) ..... 9910300
Jun. 1, 1999 (GB) ..... 9912710

(51) Int. Cl.[7] ..... G09G 5/00
(52) U.S. Cl. ..... 345/214; 345/87; 345/103
(58) Field of Search ..... 345/55, 56, 87, 345/90, 92, 204, 214, 100, 103, 104, 102

(56) References Cited

U.S. PATENT DOCUMENTS

RE30,957 E * 6/1982 Feistel ..... 380/262
5,585,950 A * 12/1996 Nishino et al. ..... 349/118
5,782,665 A * 7/1998 Weisfield et al. ..... 445/24
5,861,869 A * 1/1999 Scheffer et al. ..... 345/147
6,040,826 A * 3/2000 Furukawa ..... 345/196
6,058,137 A * 5/2000 Partyka ..... 375/131
6,144,373 A * 11/2000 Nakazawa et al. ..... 345/204
6,177,893 B1 * 1/2001 Velazquez et al. ..... 341/118
6,326,936 B1 * 12/2001 Inganas et al. ..... 345/55

FOREIGN PATENT DOCUMENTS

JP 06314083 A * 11/1994 ..... G09G/3/36
JP 07072454 A * 3/1995 ..... G02F/1/133

OTHER PUBLICATIONS

Displays, vol. 14, No. 2, 1993, pp. 74–85.
IEEE Transactions on Signal Processing, vol. 41, Mar. 1993, No. 3, pp. 1170–1183.

* cited by examiner

*Primary Examiner*—Vijay Shankar
*Assistant Examiner*—Mansour M. Said
(74) *Attorney, Agent, or Firm*—Blakely, Sokoloff, Taylor & Zafman

(57) ABSTRACT

A driving scheme for a liquid crystal display of any order and dimension, comprising matrix building blocks possessing Orthogonal and Shift Orthogonality properties. The driving scheme uses paraunitary matrices of the order M×(N+1)M as the orthogonal building blocks.

10 Claims, 3 Drawing Sheets

$$A=\begin{bmatrix} 1 & 1 & -1 & 1 & 0 & 0 & 0 & 0 & 0 & 0 \\ -1 & -1 & -1 & 1 & 0 & 0 & 0 & 0 & 0 & 0 \\ 0 & 0 & 1 & 1 & -1 & 1 & 0 & 0 & 0 & 0 \\ 0 & 0 & -1 & -1 & -1 & 1 & 0 & 0 & 0 & 0 \\ 0 & 0 & 0 & 0 & 1 & 1 & -1 & 1 & 0 & 0 \\ 0 & 0 & 0 & 0 & -1 & -1 & -1 & 1 & 0 & 0 \\ 0 & 0 & 0 & 0 & 0 & 0 & 1 & 1 & -1 & 1 \\ 0 & 0 & 0 & 0 & 0 & 0 & -1 & -1 & -1 & 1 \end{bmatrix}$$

FIG. 5

$$\begin{bmatrix} & 1 & 1 & -1 & 1 & & & 1 & 1 & -1 & 1 & & & \\ & -1 & -1 & -1 & 1 & & & -1 & -1 & -1 & 1 & & & \\ & & & 1 & 1 & -1 & 1 & & & 1 & 1 & -1 & 1 & \\ \cdots\cdots & & & -1 & -1 & -1 & 1 & & & -1 & -1 & -1 & 1 & \cdots\cdots \\ & -1 & 1 & & & 1 & 1 & -1 & 1 & & & 1 & 1 & \\ & -1 & 1 & & & -1 & -1 & -1 & 1 & & & -1 & -1 & \end{bmatrix}$$

FIG. 6

$$\begin{bmatrix} & 1 & 1 & -1 & 1 & & & & & \\ & -1 & -1 & -1 & 1 & & & & & \\ & & & 1 & 1 & -1 & 1 & & & \\ & & & -1 & -1 & -1 & 1 & & & \\ \cdots\cdots & & & & & 1 & 1 & -1 & -1 & \cdots\cdots \\ & & & & & -1 & -1 & -1 & 1 & \\ & -1 & 1 & & & & & 1 & 1 & \\ & -1 & 1 & & & & & -1 & -1 & \end{bmatrix}$$

FIG. 7

DRIVING SCHEME FOR LIQUID CRYSTAL DISPLAY

The invention relates to a driving scheme for a liquid crystal display. A passive matrix driving scheme is commonly adopted for driving a liquid crystal display. The minimise crosstalk, variations such as APT and IAPT are proposed. However, even with those improved methods, passive drive still results in high crosstalk and low contrast of the display. For those high-mux displays with liquid crystals of fast response, the problem of loss of contrast due to frame response is severe. To cope with this problem, active addressing was proposed in which orthogonal Hadamard matrix is used as the common driving signal. Each pixel is selected throughout the frame and the frame response effect becomes minimal. However, the method suffers from the problem of high computation and memory burden. Even worse, the difference in sequences of the rows of matrix results in different row signal frequencies. This may result in severe crosstalk problem. On the other hand, a variation of the active driving scheme exists, where the common driving matrix is chosen to be a block diagonal matrix made up of low order Hadamard matrices. The resulting square matrix is still orthogonal and the problems of high sequency and computation are relieved. By selecting different orders of the Hadamard building blocks, a Multi-Line-Addressing (MLA) scheme makes a compromise between frame response, sequency, and computation problems. Unfortunately, since the number of lines selected at a time is limited by the low order of the Hadamard building blocks, frame response persists.

It is an object of the invention to seek to provide a new matrix-driving scheme.

According to the invention there is provided a driving scheme for liquid crystal display of any order a dimensuion, comprising matrix building blocks posesing Orthogonal and Shift Orthogonality (SO) properties.

It will be understood that shift orthogonality refers to the property that the matrix is orthogonal to the column-shifted version of itself.

Thus, Shift Orthogonality (SO) is imposed to the common driving signal. As a result, the building blocks of the matrix become rectangular paraunitary matrices. Due to the SO property of those matrices, overlapping of the building blocks is allowed. Thus let the matrix be qxr, q and r being integers and q>r. r can be any integer multiple of q. For instance, if q=2, we can identify paraunitary matrices with r=4, 6, 8, . . . For q=3 we have r=6, 9, 12, . . . The value r is analogous to the order of the conventional MLA. It can be shown that an order-r paraunitary matrix performs similarly to an MLA-r in terms of voltage selection and bias ratios.

It will be understood that a paraunitary matrix is both orthogonal to itself and orthogonal to a column-shifted version of itself to any integer multiple of M. Using such a matrix the driving scheme out-performs MLA of the same order in terms of lower hardware complexity, less crosstalk, higher contrast and better viewing cone, and higher flexibility of implementation.

A driving scheme for a liquid crystal display embodying the invention is hereinafter described in the accompanying drawings.

FIG. 5 is a matrix representing a common driving signal.

FIG. 6 is a matrix representing a revised driving signal for a 6-way display.

FIG. 7 is a matrix representing an 8-way driving signal.

Figure 1:
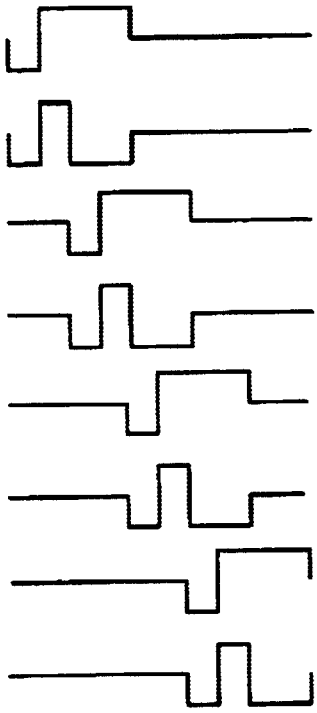
FIG. 1 is a Common (Row) Waveform for P-driving Scheme.

It will be further understood that the Shift Orthogonality (SO) property of the matrices allows overlapping of the building blocks. On the other hand, it is also possible to have row driving matrix with non-overlapped building blocks, at the expense of a larger frame size.

A driving scheme embodying the invention has the following advantages. First, the number of rows of the building block of the material equals q regardless of the order r. Therefore, the computation increases linearly with the order r (i.e. 0(r)), instead of $0(r^2)$ as in the case of MLA. Besides, as the number of rows is very limited, a difference in sequencies among the rows can be reduced by choosing an appropriate paraunitary matrix. As a result, the frame response can be removed by using a matrix with a sufficiently high order (i.e., r), without concerning the computation and sequency problems. Furthermore, as the driving matrix is now made up of overlapping building blocks, the crosstalk problem can be further relieved as the number of abrupt changes of voltages is reduced. Finally, a driving scheme embodying the invention can be implemented by choosing a paraunitary matrix of an order which is an integer multiple of q. For instance, if q=2, r=4, 6, 8, 10 . . . can be realised. Hence, more flexibility is achieved than an MLA which is made up of Hadamard matrices of orders 2, 4, 6, 8, 16, 32 . . . Owing to the overlapping property of the paraunitary building blocks, a tight frame without redundancy can generally always be realised. For instance, suppose a 10-way display is to be driven by a paraunitary matrix driving scheme of the invention (abbreviated p-drive) and MLA. For p-drive, paraunitary matrices of orders 4, 6, 8, 10 can be chosen. In each case, the frame size remains 10. However, for MLA, and order-4 Hadamard matrix results in frame size of 12 while an order-8 Hadamard results in a frame size of 16. The increase in frame size reduces the proportion of selection time and results in a lower contrast of the display in the Hadamard matrix, contrary to that of a paraunitary matrix of the invention.

Matrix driving of a LCD can be represented mathematically by the following simple linear equation.

$$Ax=b$$

where A is a mxm matrix representing an m-way common driving signal. x is a mx1 vector representing the corresponding segment driving signal. b is a column of actual data to be displayed. b is not the voltage detected by the display pixel. It can be shown that the actual detected RMS voltage are scaled and shifted versions of b. A can be any orthogonal matrix (The requirement of orthogonality will be demonstrated later). For A=I, where I is the identity matrix, the conventional passive drive is achieved. For A to be a Hadamard matrix and its derivatives, active addressing is achieved. For example, the following 8×8 Hadamard matrix can be used as the common (row) signal for active driving an 8-way display. To drive a display practically, a Hadamard matrix is commonly chosen among all orthogonal matrices for its two voltage levels. The following shows an order-8 Hadamard matrix.

$$\begin{bmatrix} 1 & 1 & 1 & 1 & 1 & 1 & 1 & 1 \\ 1 & -1 & 1 & -1 & 1 & -1 & 1 & -1 \\ 1 & 1 & -1 & -1 & 1 & 1 & -1 & -1 \\ 1 & -1 & -1 & 1 & 1 & -1 & -1 & 1 \\ 1 & 1 & 1 & 1 & -1 & -1 & -1 & -1 \\ 1 & -1 & 1 & -1 & -1 & 1 & -1 & 1 \\ 1 & 1 & -1 & -1 & -1 & -1 & 1 & 1 \\ 1 & -1 & -1 & 1 & -1 & 1 & 1 & -1 \end{bmatrix}$$

As mentioned, because of the computation burden and sequency problem of using active driving, MLA is proposed. To implement an 8-way drive by using 4-line MLA, two order-4 Hadamard matrices are used as the diagonal building blocks of the 8×8 driving matrix. The resulting common driving matrix is as follows:

$$\begin{bmatrix} 1 & 1 & 1 & 1 & 0 & 0 & 0 & 0 \\ 1 & -1 & 1 & -1 & 0 & 0 & 0 & 0 \\ 1 & 1 & -1 & -1 & 0 & 0 & 0 & 0 \\ 1 & -1 & -1 & 1 & 0 & 0 & 0 & 0 \\ 0 & 0 & 0 & 0 & 1 & 1 & 1 & 1 \\ 0 & 0 & 0 & 0 & 1 & -1 & 1 & -1 \\ 0 & 0 & 0 & 0 & 1 & 1 & -1 & -1 \\ 0 & 0 & 0 & 0 & 1 & -1 & -1 & 1 \end{bmatrix}$$

The corresponding segment driving signal is determined by $$x=A^{-1}b=A^{T}b$$

given that A is orthogonal. The condition A is non-singular is sufficient for the existence of unique x. However, in order to have the actual RMS voltage to be a shifted and scaled version of b, the condition that A is orthogonal has to be imposed.

The means of generating paraunitary matrices that will be used as the building blocks of common (row) matrix will be described hereinafter. The paraunitary condition is represented in compact matrix forms. To achieve this, a nxn shift matrix $S_{n,m}$ is introduced, as follows $$S_{n,m}=\begin{bmatrix} 0 & I_{nxn} \\ 0 & 0 \end{bmatrix}$$

A paraunitary matrix E of order Mx(N+1)M satisfies (i) E is orthogonal. i.e., $$EE'=I$$

(ii) E is orthogonal to its column shift by multiples of M. i.e., $$ES_{(N+1)M,iM}E^{T}=0$$

for i=1, 2, . . . ,N.

The set of paraunitary matrices can be obtained by the cascade lattice representation. For M=2 case, a parunitary scattering matrix E(z) (z is the variable of z-transform) of degree N+1 has a canonical factorization of the form $$E(z)=\Omega_N Z^{-1} \ldots \Omega_1 Z^{-1} \Omega_0$$

where $Z^{-1}$ is a 2×2 matrix $$Z^{-1}=\begin{bmatrix} 1 & 0 \\ 0 & z^{-1} \end{bmatrix}$$

and $\Omega_k$ denotes a rotation matrix, i.e., $$\Omega_k=\begin{bmatrix} c_k & s_k \\ -s_k & c_k \end{bmatrix}$$

with $c_k=\cos(\alpha_k)$ and $s_k=\sin(\alpha_k)$. To obtain matrix representation of E without the variable z, define block diagonal matrices $\Lambda_n \epsilon R^{2(N-n+1)\times 2(N-n+1)}$ and $Z_n \epsilon R^{2(N-n+1)\times 2(N-n+2)}$ as follows:

$$\Lambda_n=\begin{bmatrix} \Omega_n & 0 & 0 & \Lambda & 0 \\ 0 & \Omega_n & 0 & \Lambda & 0 \\ M & M & M & O & M \\ 0 & 0 & 0 & \Lambda & \Omega_n \end{bmatrix}$$

and $$Z_n=\begin{bmatrix} 1 & 0 & 0 & 0 & & & & \\ 0 & 0 & 0 & 1 & & & & \\ & & 1 & 0 & 0 & 0 & & \\ & & 0 & 0 & 0 & 1 & & \\ & & & & & O & & \\ & & & & & 1 & 0 & 0 & 0 \\ & & & & & 0 & 0 & 0 & 1 \end{bmatrix}$$

The matrix representation of a paraunitary filter bank is obtained as follows $$E=\Lambda_N Z_N \ldots \Lambda_1 Z_1 \Lambda_0$$

For N=1 there is a 2×4 E. Choosing the two angles to be π/4 radian, then there is an entry normalized paraunitary matrix $$E=\begin{bmatrix} 1 & 1 & -1 & 1 \\ -1 & -1 & -1 & 1 \end{bmatrix}$$

This matrix can be used to implement an order-4 paraunitary matrix driving scheme. For M=2 case, Ωs are 2×2 rotation matrices. For general order M case, each of the Ωs are produced by the product of M(M−1)/2 Given's rotation matrices. For a paraunitary matrix of order M×M(N+1), there are N+1 such blocks, resulting in a total of M(N+1)(M−1)/2 rotation angles.

Suppose as before there is an 8-way display. Assuming a 2×4 E with two rotational angles equal to π/4. The common driving signal (with normalized magnitude) can be repre sented as in FIG. 5 and below (see FIG. 1 of the accompanying drawing for the waveform).

$$A=\begin{bmatrix} 1 & 1 & -1 & 1 & 0 & 0 & 0 & 0 & 0 & 0 \\ -1 & -1 & -1 & 1 & 0 & 0 & 0 & 0 & 0 & 0 \\ 0 & 0 & 1 & 1 & -1 & 1 & 0 & 0 & 0 & 0 \\ 0 & 0 & -1 & -1 & -1 & 1 & 0 & 0 & 0 & 0 \\ 0 & 0 & 0 & 0 & 1 & 1 & -1 & 1 & 0 & 0 \\ 0 & 0 & 0 & 0 & -1 & -1 & -1 & 1 & 0 & 0 \\ 0 & 0 & 0 & 0 & 0 & 0 & 1 & 1 & -1 & 1 \\ 0 & 0 & 0 & 0 & 0 & 0 & -1 & -1 & -1 & 1 \end{bmatrix}$$

It is to be noticed that the frame matrix is now rectangular, insted of square as in the cases of conventional passive, active, and MLA driving schemes. For m-way display, the frame size is m+(r−M). r=M(N+1) is the number of columns of E, which is analogous to the order of MLA. The overall common driving matrix is orthogonal due to the shift orthogonal (SO) property of E.

It will be understood that:

(i) The number of rows of the building block E equals 2 regardless of the order N. This results in less computation and memory burden compared with the conventional MLA of the same order.

(ii) Sequencies of the two rows of the building blocks are respectively 1 and 2. The difference in sequencies does not increase with increasing N. For instance, for r=8 (N=3 and M=2), the two rows of E have sequencies 3 and 4. As a result, crosstalk caused by difference in row frequency components can be greatly suppressed.

(iii) The paraunitary building blocks are overlapped with each other, which results in less crosstalk caused by abrupt voltage change among pixels.

(iv) The number of column of the driving matrix, hence the frame size, is m+(r−M), which is r−M greater than that of passive drive. For instance, for a 2×4 building block E, then r−M=4−2=2. For high-mux display the decrease in selection time proportion is negligible. Nevertheless, it is possible to describe a method which allows even the frames to overlap, retaining an averaged frame size of m, as shown hereafter.

(v) Thanks to the overlapping property or the paraunitary building blocks, a tight frame without redundancy can always be realized. For instance, suppose a 10-way display by paraunitary matrix driving scheme and MLA is to be driven. For p-drive, paraunitary matrices of orders 4, 6, 8, 10 can be chosen. In any case, the frame size remains 12 (or 10 by adopting a frame overlapping method. However for, for MLA, order-4 Hadamard matrix results in frame size to 12 while order-8 Hadamard results in frame size of 16. The increase in frame size reduces the proportion of select time and results in a lower contrast of the display. The following shows the increase in frame size to 16 by adopting order-8 Hadamard matrix in MLA.

$$\begin{bmatrix} 1 & 1 & 1 & 1 & 1 & 1 & 1 & 1 & 0 & 0 & 0 & 0 & 0 & 0 & 0 & 0 \\ 1 & -1 & 1 & -1 & 1 & -1 & 1 & -1 & 0 & 0 & 0 & 0 & 0 & 0 & 0 & 0 \\ 1 & 1 & -1 & -1 & 1 & 1 & -1 & -1 & 0 & 0 & 0 & 0 & 0 & 0 & 0 & 0 \\ 1 & -1 & -1 & 1 & 1 & -1 & -1 & 1 & 0 & 0 & 0 & 0 & 0 & 0 & 0 & 0 \\ 1 & 1 & 1 & 1 & -1 & -1 & -1 & -1 & 0 & 0 & 0 & 0 & 0 & 0 & 0 & 0 \\ 1 & -1 & 1 & -1 & -1 & 1 & -1 & 1 & 0 & 0 & 0 & 0 & 0 & 0 & 0 & 0 \\ 1 & 1 & -1 & -1 & -1 & -1 & 1 & 1 & 0 & 0 & 0 & 0 & 0 & 0 & 0 & 0 \\ 1 & -1 & -1 & 1 & -1 & 1 & 1 & -1 & 0 & 0 & 0 & 0 & 0 & 0 & 0 & 0 \\ 0 & 0 & 0 & 0 & 0 & 0 & 0 & 0 & 1 & 1 & 1 & 1 & 1 & 1 & 1 & 1 \\ 0 & 0 & 0 & 0 & 0 & 0 & 0 & 0 & 1 & -1 & 1 & -1 & 1 & -1 & 1 & -1 \end{bmatrix}$$

The matrix drive of LCD is represented by the linear equation Ax=b. For passive, active, and MLA. A is a square mxm matrix. x and b are mx1 vectors. For paraunitary matrix driving, the linear equation is still valid, except that A is now a m×(m+r−M) matrix. x and b are (m+r−M)×1 vectors. M and r are as defined before, row and column sizes of E. Let n be the number of lines to be selected at a time. In paraunitary matrix driving scheme we have r=n For conventional driving, n=1 and n=m represent respectively passive and active driving schemes, while l<n<m represents n-line MLA. Let the voltage levels for the common driving be −s 0, and s, Let the number of lines selected at a time be n. Let the voltage levels for the segment driving be −d, −(n−2)d/n, −(n−4)d/n, . . . , 0, . . . d. It can be shown that $$b=\{d_s-d_s-d_s, \ldots, d_s\}^T$$

The linear matrix equation can be written in the following form . . .

$$\sqrt{n}sA'x=b$$

where A' is orthonormal. Now, let $\| \|_2$ be the 2-norm of a matrix, which is defined as the largest singular value, we have $$\|x\|_2=\frac{1}{\sqrt{ns}}\|d\|_2=\sqrt{\frac{m}{n}\frac{b}{s}}$$

which is a constant. In fact, this gives the reason why A has to be orthogonal. The RMS voltage detected across pixel j can be represented as $$O_j=\sqrt{\frac{\sum_{i=1}^{p}(a_{ji}-x_i)^2}{p}}$$

For conventional driving, p=m, while for paraunitary matrix drive, p=m+r−M.

$$O_j^2=\frac{\sum_{i=1}^{p}a_{ji}^2+\sum_{i=1}^{p}x_i^2-2\sum_{i=1}^{p}a_{ji}x_i}{p}=\frac{ns^2+\frac{md^2}{n}+2(\pm ds)}{p}$$

As a result, the selection ratio can be represented as $$r = \sqrt{\frac{ns^2 + \frac{md^2}{n} + 2ds}{ns^2 + \frac{md^2}{n} - 2ds}}$$

Let k=s/d be the bias ratio, we have $$r = \sqrt{\frac{nk^2 + \frac{m}{n} + 2k}{nk^2 + \frac{m}{n} - 2k}}$$

Differentiate r with respect to k, we obtain $$k_{opt} = \frac{\sqrt{m}}{n}$$

and $$r_{opt} = \sqrt{\frac{\sqrt{m} + 1}{\sqrt{m} - 1}}$$

It is observed that the selection ratio depends only on the number of ways m, and does not depend on whether the display is driven by passive, active, MLA, or paraunitary schemes.

Figure 2:
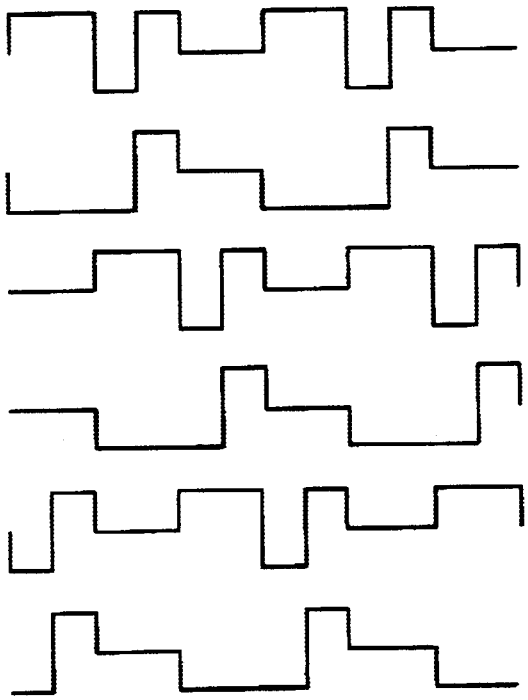
FIG. 2 is a Repeating Unit of Driving Waveform with Frame Overlap.

The number of columns of the driving matrix A introduced herein before results in a frame size of m+(r−M), which is r−M greater than that of passive drive. For instance for a 2×4 building block E, we have r−M=4−2=2. For high-mux display, the decrease in select time proportion is negligible. In the following the frames overlap with one another such that the driving signal over time is still orthogonal. This results in an easy implementation of the driving scheme by a digital filter bank approach. Also, the average frame size is reduced to m instead of m+(r−M), which results in increased select time proportion. Notice that the calculation of optimal bias and selection ratios remains the same. FIG. 6 and the following matrix shows two frames of the revised driving signal for a 6-way display (see FIG. 2 of the accompanying drawings for the waveform).

$$\begin{bmatrix} & 1 & 1 & -1 & 1 & & & & 1 & 1 & -1 & 1 & & & \\ & -1 & -1 & -1 & 1 & & & & -1 & -1 & -1 & 1 & & & \\ & & & 1 & 1 & -1 & 1 & & & & 1 & 1 & -1 & 1 & \\ \cdots & & & -1 & -1 & -1 & 1 & & & & -1 & -1 & -1 & 1 & \cdots \\ & -1 & 1 & & & 1 & 1 & -1 & 1 & & & & 1 & 1 & \\ & -1 & 1 & & & -1 & -1 & -1 & 1 & & & & -1 & -1 & \end{bmatrix}$$

Figure 3:
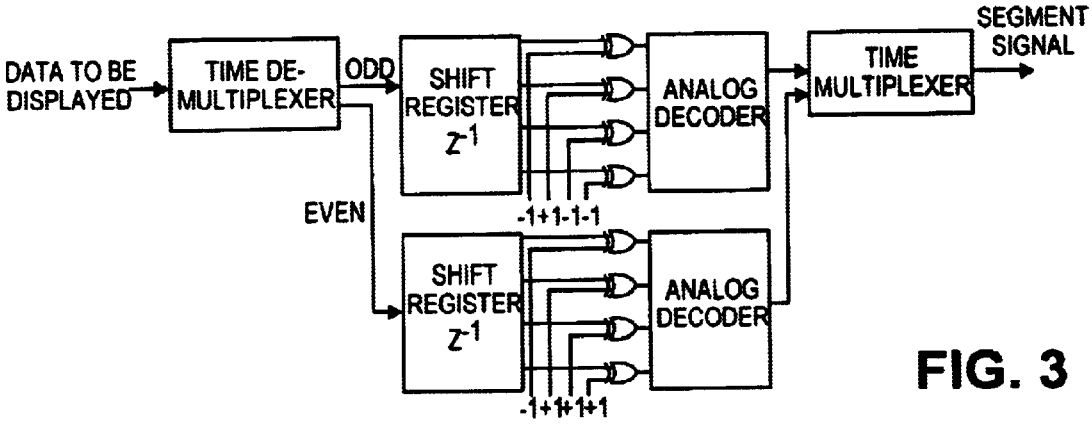
FIG. 3 is a Digital Filter Implementation of P-driving Scheme.

The revised driving scheme can easily be implemented by using a digital filter bank approach. For the case of 2×4 building block E, the two rows [1 1−1 1] and [−1−1−1 1] can be considered respectively as the low- and high-pass order-4 digital filters. The digital filter implementation is shown in FIG. 3. Notice that it is possible to choose one row instead of two as the building block. However, for a fixed number of rows of display, the frame size is now doubled and it results in a reduced select time proportion. For instance, for a 3-way display, using 1×4 building block results in an average frame size of 2×3=6.

$$\begin{bmatrix} & 1 & 1 & -1 & 1 & & & & 1 & 1 & -1 & 1 & & & \\ \cdots & & & 1 & 1 & -1 & 1 & & & & 1 & 1 & -1 & 1 & \cdots \\ & -1 & 1 & & & 1 & 1 & -1 & 1 & & & & 1 & 1 & \end{bmatrix}$$

In this case, one digital filter is needed instead of two. It is also possible to rearrange the columns of the driving matrix such that the selections are more evenly distributed. This arrangement results in an even higher contrast of the display by further suppressing the frame response. The following matrix and FIG. 7 shows the case for an 8-way drive. Without rearrangement, we have the following repeating unit of the drive signal.

$$\begin{bmatrix} & 1 & 1 & -1 & 1 & & & & & \\ & -1 & -1 & -1 & 1 & & & & & \\ & & & 1 & 1 & -1 & 1 & & & \\ & & & -1 & -1 & -1 & 1 & & & \\ \cdots & & & & & 1 & 1 & -1 & -1 & \cdots \\ & & & & & -1 & -1 & -1 & 1 & \\ & -1 & 1 & & & & & 1 & 1 & \\ & -1 & 1 & & & & & -1 & -1 & \end{bmatrix}$$

Figure 4:
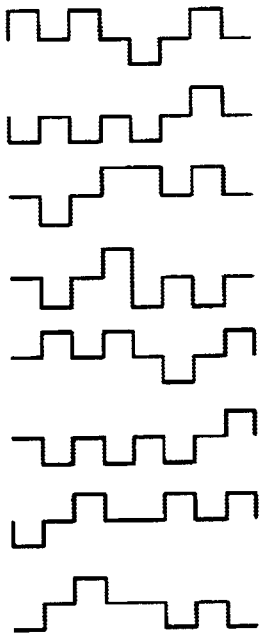
FIG. 4 is a Driving Waveform with Column Interchange.

The signal after rearrangement becomes (see FIG. 4 of the accompanying drawing for the waveform)

$$\begin{bmatrix} & 1 & & 1 & & -1 & & 1 & & \\ & -1 & & -1 & & -1 & & 1 & & \\ & & -1 & & 1 & 1 & & 1 & & \\ & & -1 & & 1 & -1 & & -1 & & \\ \cdots & & 1 & & 1 & & -1 & & 1 & \cdots \\ & & -1 & & -1 & & -1 & & 1 & \\ & -1 & & 1 & & & 1 & & 1 & \\ & -1 & & 1 & & & -1 & & -1 & \end{bmatrix}$$

Notice that there are also other possibilities as the orthogonal property of the drive signal remains by row and column interchange.

Four methods are hereinafter described for the implementation of gray scale. The first three are methods for achieving gray scales in passive and MLA driving. These methods can be adopted to implement gray scale in a paraunitary driving scheme. The fourth method is based on the use of multi-order orthogonal/paraunitary building blocks for the common signals.

In the first method frame rate control is adopted for the implementation of gray scale in passive drive and MLA. The method can be applied relatively simply to the new driving scheme. The implement n gray levels, an extended frame of size (n−1)m is adopted, where m is the original frame size for black and white display, which is typically the number of way of the display. In short, the common signals are simply constructed by concatenation of n−1 original frames for B/W display. The gray shade is determined by the number of ON among those n−1 sub-frames, ranging from 0 to n−1.

The second method is a voltage compensation method and can be adopted in the P-driving scheme. As shown herein before the RMS voltage applied at a pixel can be expressed as:

$$o_j^2 = \frac{\sum_{i=1}^{p} a_{ji}^2 + \sum_{i=1}^{p} x_i^2 - 2\sum_{i=1}^{p} a_{ji}x_i}{p}$$

where $$b_j = \sum_{i=1}^{p} a_{ji}x_i$$

For $b_j$ to be ±b as in the case of non-gray shade drive, the second term on the right hand side, which equals the square of 2-norm of b, is a constant irrespective of the signal b. This is not the case if gray shades are to be displayed. In this case, $b \leqq b_j \leqq b$ and the above mentioned term is dependent on the signal b and is not a constant. The term is maximal when all the entries making up b are ±b. To make the RMS voltage depending only on the third term, one extra time slot is added to a frame. In that extra time slot, null signal is applied to the commons. For the segment, a compensation voltage v is added such that $$o_j^2 = \frac{\sum_{i=1}^{p} a_{ji}^2 + \sum_{i=1}^{p} x_i^2 - 2\sum_{i=1}^{p} a_{ji}x_i + v^2}{p+1}$$

The voltage v is calculated such that $$\sum_{i=1}^{p} x_i^2 + v^2 = \sum_{i=1}^{p} b_i^2 + v^2 = \sum_{i=1}^{p} b^2 = pb^2 \qquad v^2 = pb^2 - \sum_{i=1}^{p} b_i^2$$

Finally, we get

The compensation voltage v is calculated for each column.

The voltage compensation method mentioned hereinbefore is based on amplitude modulation. However, that method relies on the calculation of column compensation voltage for each frame, which is computation intensive. To cope with this problem, a method has been derived for MLA, which is based on one-time extended frame.

$$\begin{bmatrix} 1 & 1 & -1 & 1 & & & & & 1 & 1 & -1 & 1 & & & & \\ -1 & -1 & -1 & 1 & & & & & -1 & -1 & -1 & 1 & & & & \\ & & & 1 & 1 & -1 & 1 & & & & 1 & 1 & -1 & 1 & & \\ & & & -1 & -1 & -1 & 1 & & & & -1 & -1 & -1 & 1 & & \\ & & & & & 1 & 1 & -1 & 1 & & & & 1 & 1 & -1 & 1 \\ & & & & & -1 & -1 & -1 & 1 & & & & -1 & -1 & -1 & 1 \end{bmatrix}$$

The method can be applied to the proposed P-driving scheme. To display the signal $b \leqq d_j \leqq b$, the signal b for the first sub-frame is made up of:

$$b_j = d_j + \sqrt{b - d_j^2}$$

while for the second sub-frame:

$$b_j = d_j - \sqrt{b - d_j^2}$$

The third term mentioned above can be derived as $$\sum_{i=1}^{p} x_i^2 = \sum_{i=1}^{p} b_i^2 = \sum_{i=1}^{p} b^2 = \sum_{i=1}^{m} \left(\left(d_i + \sqrt{b + d_i^2}\right)^2 + \left(d_i - \sqrt{b + d_i^2}\right)^2\right) = 2mb^2$$

Which is independent of the signal b as desired. It is also possible to increase the number of gray levels by combining frame rate control and amplitude modulation. On the other hand, by adopting non-uniform distribution of $d_j$ and multiple sub-frames, the number of gray levels can be increased. Realization of 4, 9, 25 gray levels is achieved by adopting 1, 2 and 3 sub-frames and four levels within a frame. The method can be applied to the proposed P-driving scheme.

In a fourth method there is provided a gray-scale method, which is based on multi-order, orthogonal/paraunitary building blocks. This method makes a compromise between the frame size and the number of voltage levels, allowing a balance to be struck between circuit complexity and LCD bandwidth requirement. If a 4-way display is to be driven to 8 gray scales, the following orthogonal common driving matrix is introduced:

$$A = \begin{bmatrix} -1 & 1 & 1 & 1 & 1 & 1 & 0 & 0 & 1 & 0 & 0 & 0 \\ 1 & 1 & -1 & 1 & 1 & -1 & 0 & 0 & 0 & 1 & 0 & 0 \\ 1 & -1 & 1 & 1 & 0 & 0 & 1 & 1 & 0 & 0 & 1 & 0 \\ 1 & 1 & 1 & -1 & 0 & 0 & 1 & -1 & 0 & 0 & 0 & 1 \end{bmatrix}$$

For driving a higher mux display, the matrix can be used as the diagonal building blocks in a higher order common driving matrix. The matrix is a cascade of orthogonal square matrices of order $2^2$, $2^1$, and $2^0$. If there are n different ordered orthogonal building blocks, $2^n$ gray scales will be possible and the common driving matrix will be of order $2^{n-1} \times n2^{n-1}$. Let the display be of m-mux, if we calculate the segment driving signal by $$x = A^T b$$

the number of voltage levels to represent x becomes $2^{n-1}+3$. The RMS voltages become $$V_{on/off} = \sqrt{2^n - 1}\sqrt{\frac{s^2 + md^2 \pm 2ds}{mn}}$$

where d is now the smallest segment voltage. With $$k_{opt} = \sqrt{m}$$

and $$r_{opt} = \sqrt{\frac{\sqrt{m} + 1}{\sqrt{m} - 1}}$$

which achieve the same performance as ordinary passive/active drive. The proportion of selection per frame of the proposed scheme is $(2^n-1)/n$, which is higher than ordinary passive drive. We may also use paraunitary matrix as the building blocks. For the above example, we then have $$A=\begin{bmatrix} 1 & 1 & -1 & 1 & & & 1 & 1 & & & 1 & & & \\ -1 & -1 & -1 & 1 & & & 1 & -1 & & & & 1 & & \\ & & 1 & 1 & -1 & 1 & & & 1 & 1 & & & 1 & \\ & & -1 & -1 & -1 & 1 & & & 1 & -1 & & & & 1 \end{bmatrix}$$

The scheme can be modified to reduce the number of segment voltage levels, at the expense of a larger frame as mentioned before. If a 2-way LCD is to be driven to 8 gray levels. Let the common driving signal matrix be $$A=\begin{bmatrix} 1 & 1 & -1 & 1 & 1 & 1 & 1 & 0 \\ -1 & -1 & -1 & 1 & 1 & -1 & 0 & 1 \end{bmatrix}$$

Let A' be $$A'=\begin{bmatrix} 1 & 1 & -1 & 1 & & & & \\ -1 & -1 & -1 & 1 & & & & \\ & & & & 1 & 1 & & \\ & & & & 1 & -1 & & \\ & & & & & & 1 & \\ & & & & & & & 1 \end{bmatrix}$$

By calculating x by $x=A'^{T}b$. The number of voltage levels can be restricted to 5 regardless of n. However, the frame size is now increased to $m2^{n-1}$. To achieve 8 gray levels, the frame is enlarged 4 times. The selection per frame is now $(2^n-1)/2^{n-1}$, which is higher than ordinary passive drive. The RMS voltages are $$V_{on/off}=\sqrt{\frac{2^n-1}{m2^{n-1}}}\sqrt{s^2+md^2\pm 2ds}$$

where d is as mentioned before, the smallest segment voltage. We have $$k_{opt}=\sqrt{m}$$

and $$r_{opt}=\sqrt{\frac{\sqrt{m}+1}{\sqrt{m}-1}}$$

which is the same as ordinary passive/active driving schemes. Notice that for driving a higher mux display, the matrix A' can be used as the diagonal building blocks in a higher order common driving matrix (i.e., diag(A', A', . . . , A')). The number of row of the resulting driving matrix is n times the mux m. Where $2^n$ is as mentioned above, the number of gray levels. The data b should be presented in a binary format such that the first frame is responsible for the most significant bit, while the last frame is for the least significant bit.

There is provided in a driving scheme of the invention;

(1) A new driving scheme for liquid crustal display which uses paraunitary matrices of order M×(N+1)M as the orthogonal building blocks. The new driving scheme out-performs MLA of the same order in terms of lower hardware complexity, less crosstalk, higher contrast and better viewing cone, and higher flexibility of implementation.

(2) The paraunitary matrices above posses a Shift Orthogonality (SO) property that allows overlapping of the building blocks. This results in possibility of implementing a general order-r driving scheme, where r=(N+1)M can be any positive integer by choosing appropriate N and M.

(3) The new driving scheme can be implemented by using an efficient digital filter bank approach (FIG. 3).

(4) Rows can be selected from the M×(N+1)M paraunitary matrix to realize a driving signal with increased frame size. This results in a reduced hardware complexity. For instance, by selecting one row out of the two rows of a 2×2(N+1) paraunitary matrix, the driving scheme can be realized by one digital filter. However, the frame size is doubled that results in a reduced selection time proportion.

(5) It is also possible to rearrange the rows and columns of the driving matrix such that the selections are more evenly distributed. This arrangement resulting in an even higher contrast of the display by further suppresses the frame response. Various configurations are possible as the orthogonal property of the drive signal remains by row and column interchange.

(6) Using a number of rows of a paraunitary matrix can result in reduced hardware complexity.

(7) By using more evenly distributed rows and columns of the driving matrix, this arrangement results in an even higher contrast of the display by further suppressing the frame response.

(8) Using a grey seal method, there is provided a compromise between the frame size and the number of voltage levels, allowing us to strike a balance between circuit complexity and LCD bandwidth requirement.

(9) A paraunitary matrix can have the property of shift orthogonality, in which the parenting building blocks either overlap without affecting the orthogonal property of the driving matrix, or are not overlapped with each other, at the expense of an increased frame size.

(10) Thus, there is proposed a driver for a liquid crystal display of any order and dimension which comprises matrix building blocks possessing orthogonal and shift orthogonality (SO) properties. SO refers to the property that the matrix is orthogonal to the column-shifted version of itself.

We claim:

1. A driving scheme comprising:

(i) matrix building blocks, said blocks possessing Orthogonal and Shift Orthogonality (SO) properties;

(ii) wherein there is provided a row driving matrix; and (iii) wherein said matrix building blocks overlap, while maintaining an orthogonal property of the row driving matrix, for operation of a liquid crystal display of any order and dimension.

2. A driving scheme as defined in claim 1, wherein there is provided a row driving matrix being generated by using the paraunitary matrices as building blocks.

3. A driving scheme as defined in claim 1, wherein any number of rows is selected from the M×(N+1)M paraunitary matrix to realize a driving signal with increased frame size.

4. A driving scheme as defined in claim 3, wherein there is selected one row out of the two rows of a 2×2 (N+1) paraunitary matrix whereby to provide a driving scheme by one digital filter.

5. A driving scheme as defined in claim 1, wherein there is a digital filter bank.

6. A driving scheme as defined in claim 1, wherein the rows and columns of the driving matrix are rearranged such that the selections are more evenly distributed.

7. A driving scheme as defined in claim 1, wherein there is a gray-scale addressing method based on multi-order orthogonal/paraunitary building blocks.

8. A driving scheme as defined in claim 7, wherein there is a paraunitary matrix with shift orthogonality, whereby paraunitary matrix building blocks overlap without affecting the orthogonal property of the row driving matrix.

9. A driving scheme as defined in claim 7, wherein there is a paraunitary matrix with shift orthogonality, whereby paraunitary matrix building blocks are not overlapped.

10. A liquid crystal display, incorporating a driving scheme as defined in claim 1.

* * * * *